United States Patent [19]

Robinson et al.

[11] 4,112,802

[45] Sep. 12, 1978

[54] ORGAN CIRCUITRY FOR PROVIDING FILL NOTES AND METHOD OF OPERATING THE ORGAN

[75] Inventors: John William Robinson, Jasper, Ind.; Thomas C. Crosby, Monroeville, Pa.; Stephen Louis Howell, Ireland, Ind.

[73] Assignee: Kimball International, Inc., Jasper, Ind.

[21] Appl. No.: 752,830

[22] Filed: Dec. 20, 1976

[51] Int. Cl.[2] ..... G10H 1/00; G10H 5/00

[52] U.S. Cl. ..... 84/1.01; 84/1.03; 84/1.17; 84/DIG. 22

[58] Field of Search ..... 84/1.01, 1.03, 1.17, 84/1.24, DIG. 12, DIG. 22

[56] References Cited

U.S. PATENT DOCUMENTS 3,823,246 7/1974 Hebeisen et al. ..... 84/1.17

*Primary Examiner*—Stanley J. Witkowski

*Attorney, Agent, or Firm*—Albert L. Jeffers; John F. Hoffman

[57] ABSTRACT

An organ circuitry for providing fill notes and a method of operating the organ in which a circuit is provided which adds fill notes automatically in the multiplexed solo manual of an electronic organ, by detecting the first pulse encountered by the multiplexer during a scan of the keyboard and developing further pulses in conformity therewith but pertaining to notes within the octave beneath the note corresponding to the detected pulse, and combining the pulses on a data stream which is demultiplexed for actuating keyers.

30 Claims, 5 Drawing Figures

ORGAN CIRCUITRY FOR PROVIDING FILL NOTES AND METHOD OF OPERATING THE ORGAN

BACKGROUND OF THE INVENTION

The present invention relates to electronic organs and is particularly concerned with novel organ circuitry and a method of operation of the organ in which fill notes are automatically provided for filling in the portion of a composition played on the solo manual.

The provision of fill notes in keyboard rendered compositions such as organ compositions are well known and are generally provided by a skilled player in conformity with the notes being played by the left hand and the note or notes being played by the right hand. Thus, a skilled player may play an octave on the right hand in the solo manual and, in addition, fill in two or three notes which harmonize with the notes of the octave and with the chord being played at the same time.

The described supplying of fill notes in the described manner is difficult for anyone having less than a high degree of skill and, accordingly, it has more recently been proposed to provide for such fill notes automatically.

Amongst patents to be found in the literature showing the supplying of fill notes automatically are U.S. Pat. Nos. 3,929,051; 3,823,246; 3,990,339; 3,247,310 and 3,283,056.

The present invention relates to an improved method and circuitry for obtaining fill notes of the nature referred to and has as its primary object the provision of extremely simple and straightforward circuit arrangement and a method of processing signals in the circuit arrangement which is simpler and more direct than circuit arrangements according to the prior art.

BRIEF SUMMARY OF THE INVENTION

According to the present invention, a keyboard of the organ, especially the solo manual, is multiplexed from the top to the bottom in a known manner thereby to provide a data stream consisting of time displaced data bits, each corresponding to a respective key and each having a logic level in conformity with whether or not a respective key is in released or depressed condition.

According to the present invention, the accompaniment manual in the organ, which may be a keyboard separate from the solo manual or a section thereof toward the left, includes at least a group of keys each adapted when depressed for causing a respective chord to sound.

According to the present invention, the first depressed note in a solo manual encountered by the multiplexer supplies a signal and this signal is delayed in conformity with the particular chord being played and is employed for providing one or more pulses in respective time slots which are added into the aforementioned data stream in such a position that, when the data stream is demultiplexed, the notes sounded by the added pulses or signals will be within an octave of the original first encountered pulse in the data stream.

In one modification, the first detected pulse in the data stream is supplied to a shift register and is shifted therealong simultaneously with the scanning of the keys in the solo manual with pulses being gated from the shift register back to the data stream at desired positions of the pulse along the shift register.

In another modification, the binary count from the counter in the multiplexer corresponding to the first detected pulse is latched into a latch and supplies arithmetic logic units, each operable to add a selected amount to the binary number supplied thereto from the latch.

The binary count in the latch also operates to enable a respective portion of a memory with the memory being addressed in conformity with the particular chord playing key that is depressed. The memory will supply a respective second digital word to each of the arithmetic logic units, and the aforementioned addition will take place therein, and the resulting sum arrived at in each arithmetic logic unit will appear at the outputs thereof.

The output of each of the arithmetic logic unit forms one input of a respective word comparator with the other input to each word comparator consisting of the output of the multiplexer counter.

In a conventional manner, each word comparator will produce a pulse when the two inputs thereto are equal and this pulse will be added to the data stream.

In each of the modifications referred to, it will be apparent that the pulse developed on the data stream by the first depressed key encountered during a scan of the keyboard sets into motion the adding of pulses to the data stream in time slots which are automatically selected in conformity with the respective chord playing key which is depressed.

The exact nature of the present invention will become more clearly apparent upon reference to the following detailed specification taken in connection with the accompanying drawings in which.

DETAILED DESCRIPTION OF THE INVENTION

Figure 1:
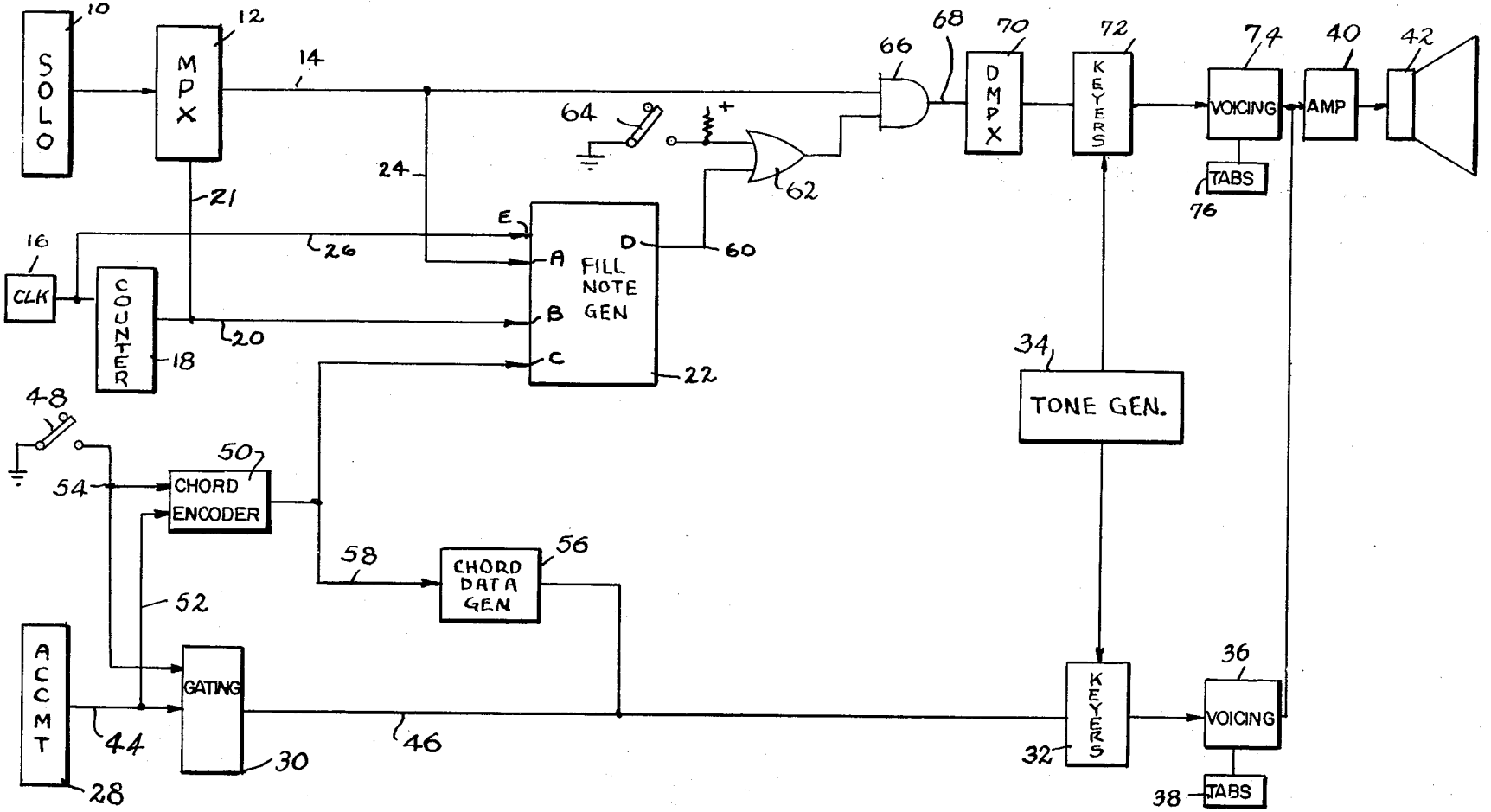
FIG. 1 is a schematic block diagram showing the circuit of the present invention.

Referring to the drawings somewhat more in detail, in FIG. 1, 10 represents a solo keyboard and 12 represents a conventional multiplexing system which scans the keyboard 10 from top to bottom and supplies a data stream to wire 14 consisting of a plurality of time displaced bits with each bit having logic level conforming to the position of the respective key.

Normally, the logic level on line 14 stays high and goes low when a depressed key is encountered during the scanning of the multiplexer.

A master clock 16 drives a counter 18 which has the output 20 connected by wire 21 to an input of multiplexer 12 and to the B input of a file note generator 22.

The fill note generator 22 also receives an input at A via wire 24 from wire 14 carrying the data stream. A clock input from master clock 16 is conveyed to fill note generator 22 by wire 26 which is connected to point E as shown in FIG. 1.

The accompaniment keyboard of the organ is indicated at 28 and it is normally connected via a gating circuit 30 with a bank of keyers 32 which receive tone signals from tone generator 34 and control the supply thereof to conventional organ voicing 36 under the control of tabs 38. The output from voicing 36 is supplied via amplifier means 40 to speaker means 42.

When accompaniment manual keys 28 are connected by wires 44 and 46 directly with keyers 32, each key of the manual causes a respective tone to sound. However, when a switch 48 is closed, circuit 30 is disabled for passing signals and, instead, a chord encoding circuit indicated at 50 is enabled and which receives signals from keys 28 via a wire 52.

The enabling of chord encoding circuit 50 and the disabling of circuit 30 is accomplished by signals supplied thereto from switch 48 via wire 54.

When chord encoding circuit 50 is made effective, it becomes operable through a chord data generator 56 to supply a respective chord for fill note of at least some of the keys of the accompaniment manual 28 which are depressed. The circuit at 50 also supplies a signal via output 58 to the terminal marked C of the data generator 22.

At this point, it might be pointed out that the circuit at 50 might comprise, for example, an arrangement for encoding the group of keys referred to, and which may be called "chord playing keys" and employing the encoded signal and a chord data generator for generating keyer actuating signals for actuating the keyers at 32 which will produce the desired chord.

Such chord forming arrangements are known in the art and, per se, form no part of the present invention except that the generator at 22 is interconnected with the chord data generator at 56 so that the fill notes provided according to the present invention are hormoniously related to the chord being played.

Generator 22 has an output line 60 connected to the D terminal thereof and forming one input of an OR gate 62. The other input of the OR gate is adapted for being connected to ground via a selector switch 64. When switch 64 is closed, the negative going signals supplied to wire 60 by generator 22 will pass through the OR gate to one input of an AND gate 66, and when switch 64 is open, the output of OR gate 62 will stay high at all times and will not be influenced by any signal output from generator 22.

The pulses supplied to wire 14 by multiplexer 12 which correspond to key down signals are also negative going so that the AND gate at 66 forms an arrangement in which the pulses at wire 14 and the pulses from or gate 60 are OR'd together and supplied thereby to wire 68 for supply to the demultiplexer 70.

The output of demultiplexer 70 actuates keyers 72 which receive tone signal inputs from tone generator 34 and the actuated ones of the keyers will supply the tone signals through voicing 74 under the control of tab switches 76 to amplifier 40 and thence to speaker means 42.

Figure 2:
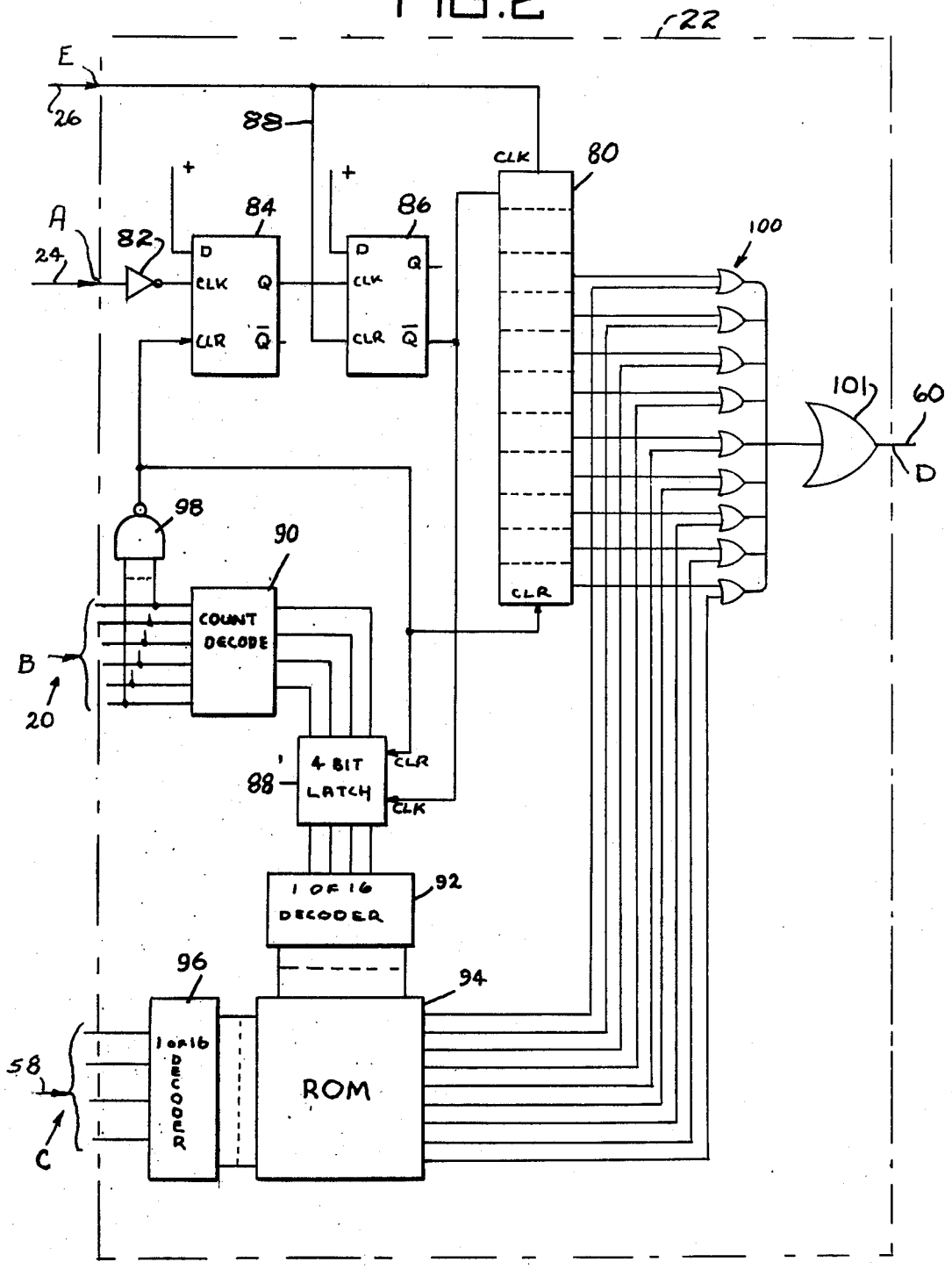
FIG. 2 is a detailed showing of a portion of the circuit of FIG. 1 showing one modification of the invention.

Referring to FIG. 2, one arrangement of the fill note generator 22 is illustrated in detail.

In FIG. 2, it will be noted that wire 26 connected to input E goes to the clocking input of shift register 80 so that the register is clocked continuously.

Wire 24, which is connected to input A, is connected through an inverter 82 to the clocking input of a D-type flip-flop 84. Flip-flop 84 has the Q output connected to the clocking input of a second D-type flip-flop 86. The clear input of flip-flop 86 is connected by wire 88 to wire 26 so that the first pulse only appearing on wire 24 during a multiplexing cycle will be supplied to the Q output of flip-flop 86 and from there to the input terminal of the first stage of shift register 80 and to the clocking input of a four bit latch 88'.

The output of counter 18 is supplied by connection 20 to the B input of generator 22 which is supplied to a count decoder 90 which supplies a four bit word to the input side of latch 88' with this four bit word being transferred to the output side of the latch whenever a pulse appears at the clocking input of the latch.

The four bit word from latch 88' is supplied by one of sixteen decoder 92 having a plurality of output lines, one of which is enabled for each binary number supplied to the input side of the decoder. The decoder outputs are employed as enabling inputs for a read only memory 94 which is addressed by the outputs from a further one of sixteen decoder 96 which is supplied with a four bit word from circuit 50 at input connection C of fill note generator 22.

The counter input at input B from the counter 18 is also connected through a NAND gate 98 with the clear inputs of D-type flip-flop 84, four bit latch 88' and shift register 80 so that, following a complete scan of the keyboard and prior to the beginning of another scan, an end-of-scan clearing pulse will be supplied to flip-flop 84, latch 88' and shift register 80 to clear all of the data therefrom.

Turning now to shift register 80, certain ones of the outputs thereof, for example, the fourth to the tenth, form one input to each of a group of OR gates 100 with the other inputs of the gates being connected to the outputs of read only memory 94. Shift register 80 could, of course, be longer if so desired.

The outputs of the read only memory, when the read only memory is supplied with a decoded four bit word from decoder 92 and a single input from decoder 96, is a signal on one or more of the wires leading to the aforementioned other inputs of OR gates 100. The outputs of read only memory 94 are normally high, and all of gates 100 are disabled, but when signals are supplied by the read only memory, certain ones of the outputs will go low, and this will enable the gates 100 for passing the signal in the shift register through OR gate 101 to output terminal D which is connected to output wire 60. OR gate 101 provides further isolation of gates 100.

From the foregoing, it will be seen that fill notes can be provided at any desired position relative to the solo key being played and that the fill notes thus supplied will be harmonically related to the chord being played due to the connection of the chord playing key through the circuitry which is provided for addressing memory 94.

Figure 3:
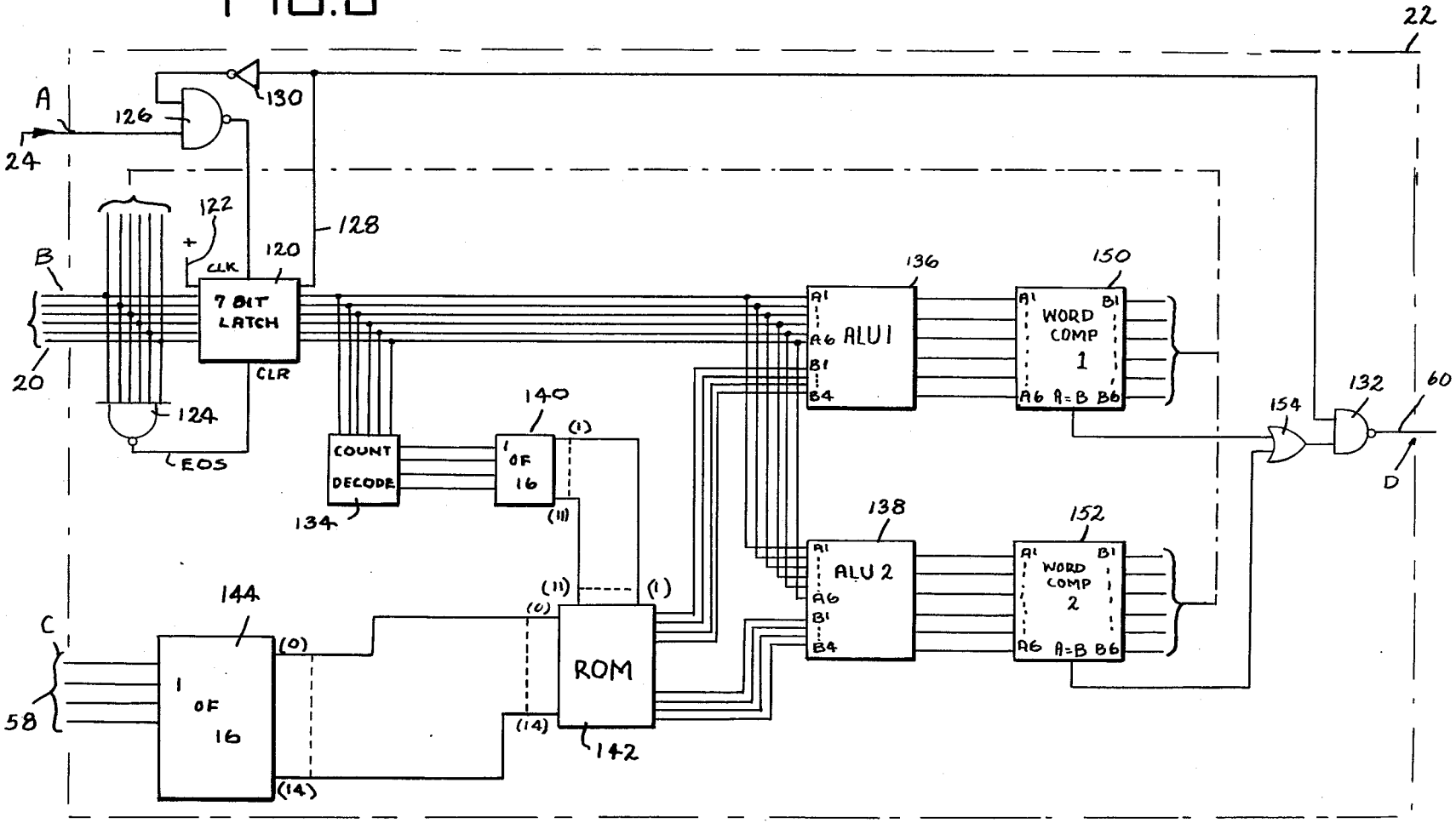
FIG. 3 is a view like FIG. 2 but showing another modification of the invention.

FIG. 3 shows an arrangement similar to that of FIG. 2, but in FIG. 3, the output of counter 18 which is supplied to terminal B of fill note generator circuit 22 is connected to a seven bit latch 120 which has one input terminal 122 connected to the supply voltage. An end-of-scan NAND gate 124 is also provided having an output connected to the clear terminal of latch 120.

In response to a key down pulse appearing on wire 24, a signal is supplied through NAND gate 126 to the clocking input of latch 120 and the count of counter 18 corresponding to the pulse is thus latched into latch 120 and appears at the output terminals thereof.

The output terminal of the latch corresponding to the input 122 is connected by wire 128 through an inverter 130 to the other input of NAND gate 126 thereby to hold the output of the gate high and prevent further clocking of latch 120. Wire 128 is also connected to form one input to an output NAND gate 132 to be described hereinafter.

The six outputs of latch 120 corresponding to the word input at terminal B are supplied to a count decoder 134 and also has one input to each of a pair of arithmetic logic units 136 and 138.

The count decoder 134 supplies a four bit word to a one of sixteen decoder 140, the outputs of which are adapted to enable selected lines of a read only memory 142. The memory 142 is adapted for being addressed by an output of a one of sixteen decoder 144, the input of which is supplied by a four bit word via input terminal C of circuit 22 which, as will be seen in FIG. 1, leads to circuit 50.

The read only memory 142 supplies respective four bit words to arithmetic logic units 136 and 138 for adding to the count supplied thereto from latch 120. The words supplied to the respective logic units 136 and 138 from memory 142 are different so that each arithmetic logic unit supplies a different word and a respective word comparator 150, 152.

The other inputs to the word comparators are supplied from the aforementioned input B which is connected to the output side of counter 18. By adding selectively different words to the latched in count in counter 120, the word comparators at 150 and 152 will supply respective pulses at the outputs thereof when the two inputs are equal with these outputs being supplied through an OR gate 154 to the aforementioned NAND gate 132 and thence to wire 60 which is connected to the D terminal of the fill note generator 22.

It will be apparent that the binary words supplied by read only memory 142 can be such that the pulses which are generated at line 60 are displaced from the pulse that has the corresponding count latched in latch 120 to provide for fill notes in the proper position along the musical scale, or any other notes that might be desired.

In the modification of FIG. 3, it will be evident that the end-of-scan pulse supplied to the clear terminal of latch 120 will re-set the entire circuitry preparatory to the next scan of the keyboard.

From the foregoing, it will be understood that, in scanning the keyboard from the top to the bottom, the counter numbers increase selectively from the top to the bottom of the keyboard. The circuit could, of course, be arranged for the counter numbers to decrease.

It will also be apparent that the output of OR gates 100 could supply the terminals of a further OR gate if isolation of gates 100 is desired.

It will also be understood that, due to the high frequencies encountered, it is preferable to have a debounce circuit interposed in the circuit which supplies the data from the fill notes to be certain always to activate the system on the proper note.

Figure 4:
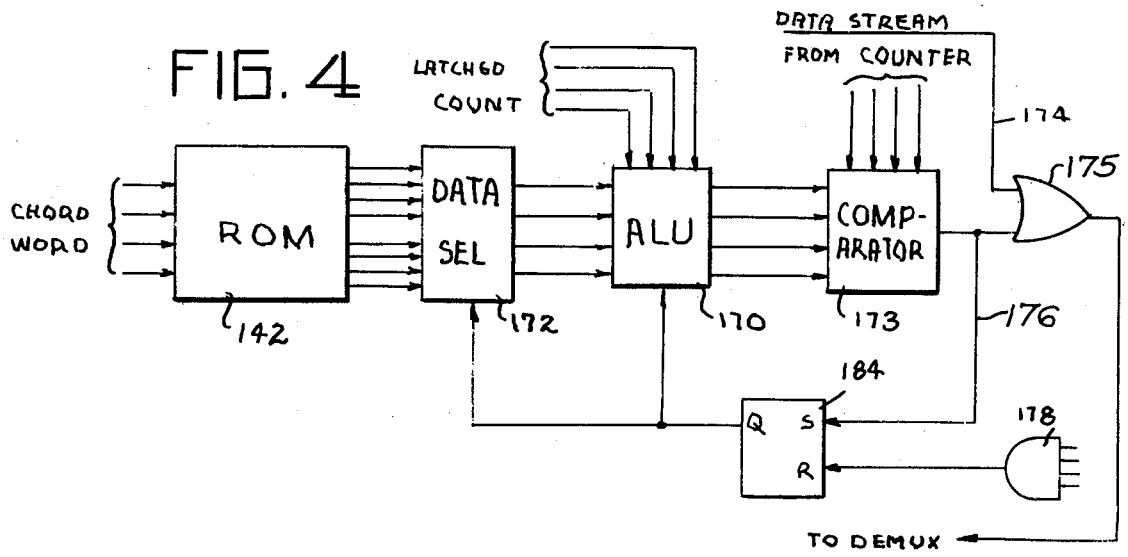
FIGS. 4 and 5 are fragmentary views of modified circuit arrangements.

FIG. 4 shows a somewhat modified arrangement which operates substantially the same as the FIG. 3 circuit. In FIG. 4, ROM 142 is the same as ROM 142 of FIG. 3. However, only a single arithmetic logic unit at 170 is employed with a data selector 172 interposed between ROM 142 and unit 170. Since only a single unit 170 is employed, a single comparator 173 may be employed which supplies signals for combining at OR gate 175 with the signals on the wire 174 carrying the data from the solo manual multiplexer.

In FIG. 4, the use of a single logic unit 170 is permissible because of the use of a flip-flop 184 which is set upon the occurrence of a first pulse on wire 176 leading from comparator 173 and is reset by the output signal from an end-of-scan gate 178. In operation, as soon as one pulse is detected and processed through the comparator 173 to supply a pulse for incorporation in the data stream, the flip-flop 184 is set and makes another selection via data selector 172 and the process is repeated to supply a second pulse for incorporation in the data stream thereby providing for the supply of two pulses to cause fill notes to sound at the octave beneath the highest key depressed in the solo manual. At the end-of-scan, the flip-flop 184 is set and the operation can be repeated.

Figure 5:
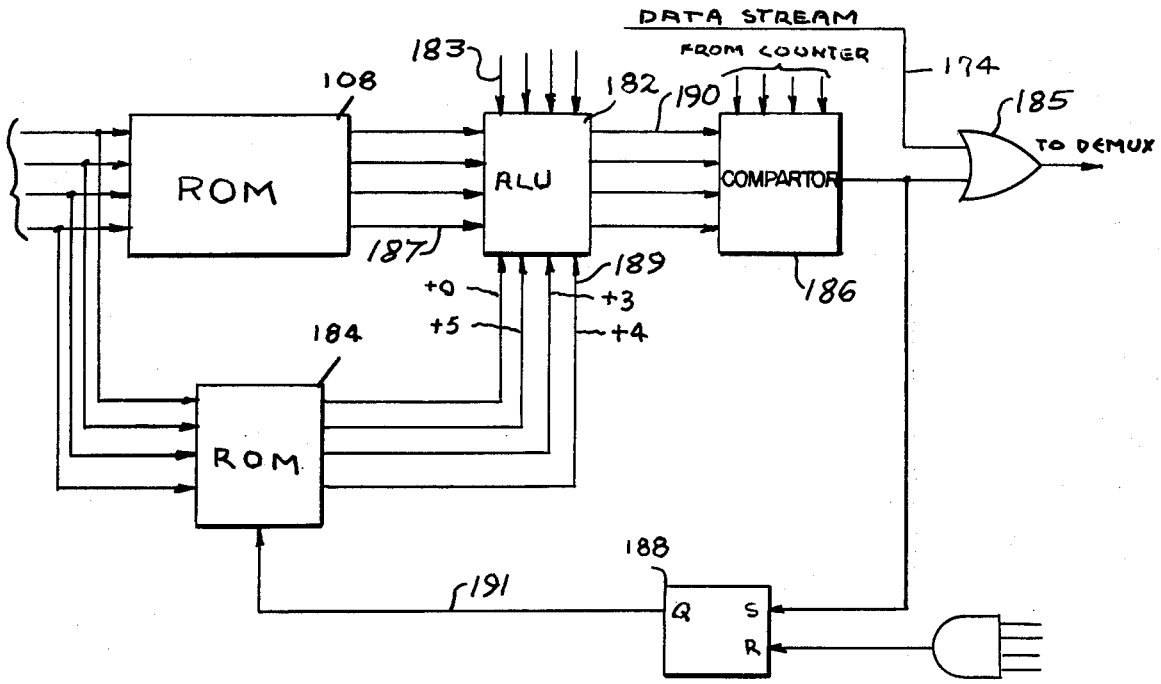

FIG. 5 shows an arrangement in which the fact is utilized that there exists an acceptable mathematical relation between the first and second fill notes to be supplied, taking into account that when a minor chord is played the fill notes have one spacing and when a major chord is played the fill notes have another spacing while still a third spacing obtains when a diminished chord is played.

By taking advantage of this situation, the ROM, which decodes the chord word, can be reduced to half the size that it has in FIGS. 2 to 4 because it is only required to output a single word. Thus, ROM 108 in FIG. 5, which corresponds to ROM 94 in FIG. 2 and ROM 142 in FIGS. 3 and 4, is supplied at the left by the encoded signal from the accompaniment keyboard and supplies to an arithmetic logic unit 182 a single four-bit word.

The encoded chord word is also supplied as an input to a second ROM 184 which can supply as an output signals to respective wires having the values indicated on the output wires. The arithmetic logic unit at 182 not only receives the latched count from the solo multiplexer indicated by the lines 183 at the top of the logic unit but also receives the output of the ROM 108 as indicated by the wires 187 at the left and, still further, receives a signal from one of the four wires 189 connected to the lower side thereof.

On the first key down signal encountered in scanning the upper manual, a first one of the output wires 190 of ROM 184 is effective and, when comparator 186 supplies a pulse to OR gate 185 for incorporation in the data stream on wire 174, a flip-flop 188 is also set which supplies a signal via wire 191 to memory 184. The one of the output wires 190 from memory 184 is thus changed and a different value is fed into the logic unit 182.

The flip-flop 188 is, of course, reset at the end-of-scan preparatory to a new cycle.

The arrangement of FIG. 5 permits the ROM 180 to be made substantially smaller and requires only one arithmetic logic unit at 182 and adjusts the spacing between the pulses pertaining to the fill notes as supplied at the output of comparator 186 in conformity with the value supplied to unit 182 from memory 184.

Modifications may be made within the scope of the appended claims.

What is claimed is:

1. The method of operating an electronic organ having tone generator means and transducer means and keyers interposed therebetween, keyboard means having playing keys and comprising a solo portion and an accompaniment portion, a multiplexer for scanning at least said solo portion of said keyboard and including a clock driven binary counter, said multiplexer generating a data stream on each scan of the keyboard containing key down signals in respective time slots for each depressed playing key, and a demultiplexer synchronized with and connected to said multiplexer and responsive to key down data supplied thereto by said multiplexer for actuating said keyers, said playing keys including chord playing keys each operable when depressed to cause a chord to sound, said method comprising: storing the count from the counter which corresponds to the first depressed key encountered during a scan of the keyboard, adding two predetermined different binary words to the count to form a pair of binary words of differing but both of higher value than the stored count, comparing the two thus formed binary words with the count from the counter to develop two pulses when the compared words are equal to the respective counts of the counter, and supplying the pulses sequentially to the demultiplexer in the time slots corresponding to said respective counts.

2. The method of operating an electronic organ having tone generator means and transducer means and keyers interposed therebetween, keyboard means having playing keys and comprising a solo portion normally played by the right hand and an accompaniment portion normally played by the left hand, a multiplexer for scanning at least said solo portion of said keyboard and including a clock driven binary counter, said multiplexer generating a data stream on each scan of the keyboard containing key down signals in respective time slots for each depressed solo playing key, and a demultiplexer synchronized with and connected to said multiplexer and responsive to key down data supplied thereto by said multiplexer for actuating said keyers, said accompaniment portion including a predetermined group of playing keys, said method comprising: providing a multiple stage shift register, inserting a signal into the first stage of the multiple stage shift register upon the first occurrence of a depressed playing key during a scan of the keyboard, clocking the shift register in unison with the scanning of the playing keys to shift said signal therealong, interposing further keyers between selected ones of said stages and the input of said demultiplexer, and enabling at least one said further keyer in conformity with the depression of a predetermined one of the playing keys on said accompaniment portion of said keyboard means to cause at least one additional note to sound from the solo portion of said keyboard.

3. The method according to claim 2 which includes enabling at least two of said further keyers for each of said predetermined ones of said playing keys which is depressed to cause at least two additional notes to sound from said solo portion of said keyboard.

4. The method according to claim 2 in which said additional note is within an octave range of the note corresponding to the said depressed solo playing key.

5. The method according to claim 3 in which both of said additional notes are within an octave range of the note corresponding to the said depressed solo playing key.

6. The method of operating an electronic organ having tone generator means and transducer means and keyers interposed therebetween, keyboard means having playing keys and comprising a solo portion and an accompaniment portion, a multiplexer for scanning at least said solo portion of said keyboard and including a clock driven binary counter, said multiplexer generating a data stream on each scan of the keyboard containing key down signals in respective time slots for each depressed solo playing key, and a demultiplexer synchronized with and connected to said multiplexer and responsive to key down data supplied thereto by said multiplexer for actuating said keyers, said playing keys including a predetermined group of the accompaniment manual playing keys each operable when depressed to cause a chord to sound, said method comprising; storing the count from the counter which corresponds to the first depressed solo playing key encountered during a scan, generating a predetermined binary word for each of said predetermined group of playing keys which is depressed, combining said predetermined binary word with the stored count to form a further binary word, comparing the further word with the count from the counter and developing a pulse when the compared words are equal, and supplying the pulse to the demultiplexer.

7. The method according to claim 6 in which a pair of binary words are developed for the depression of each key of said predetermined group of keys, combining the said pair of words individually with the stored count to form a pair of new binary words, comparing the two thus formed new binary words with the count from the counter and developing a pulse when the compared words are equal, and supplying the pulses sequentially to the demultiplexer in the time slots corresponding to the respective said counts.

8. The method according to claim 6 in which the pulse is in a time slot corresponding to a key within an octave range of said depressed solo playing key.

9. The method according to claim 7 in which both of said pulses are in time slots corresponding to keys within an octave range of said depressed solo playing key.

10. The method according to claim 6 in which a pair of binary words are developed for the depression of each key of said predetermined group of keys, combining one of said words with said stored count to form a first new binary word of greater value than said stored count, comparing the first new word with the count from the counter and developing a pulse when the compared words are equal, and supplying the pulse to the input of the demultiplexer, combining the other of said words with said stored count to form a second new binary word of greater value than said first new binary word, comparing the second new word with the count from the counter and developing a pulse when the compared words are equal, and supplying the pulse to the input of the demultiplexer.

11. The method according to claim 6 which includes adding at least one further binary word to the stored count following the supply of the said pulse to said demultiplexer to form a second new binary word for comparison with the count from said counter and the supply of a pulse to said demultiplexer when the counter count and the second new binary word are equal.

12. In an electronic organ including a keyboard having playing keys and comprising a solo portion and an accompaniment portion, multiplexer means for scanning at least said solo portion of said keyboard and including a clock driven binary counter, said multiplexer means generating a data stream on each scan of the keyboard containing key down data in the form of a key down signal in a respective time slot for each depressed playing key, and demultiplexer means connected to said multiplexer means, fill note generating means operable in response to the development of an initiating key down signal in said data stream and to the depression of a playing key of said accompaniment portion for supplying at lease one pulse corresponding to a key down signal to the demultiplexer in a time slot different from the time slot pertaining to the respective key down signal, said fill note generating means including multi-stage shift register means through which said initiating key down signal is shifted in synchronism with the scanning of said solo portion of said keyboard, and said one pulse being supplied simultaneously with the shifting of said initiating key down signal through a selected stage of said shift register means.

13. An electronic organ according to claim 12 in which said fill note generating means is operable for supplying a pair of pulses in respective time slots and both of which are different from the time slot pertaining to the respective key down signal.

14. An electronic organ according to claim 12 in which the said time slot in which said pulse is supplied is a time slot within an octave range of the time slot corresponding to the time slot pertaining to the respective key down signal.

15. An electronic organ according to claim 14 in which the said time slots in which said pulses are supplied are time slots within an octave range of the time slots corresponding to the time slots pertaining to the respective key down signals.

16. An electronic organ according to claim 12 which includes means for making said fill note generating means effective upon the first occurrence only of a key down signal during a scan of said keyboard means.

17. An electronic organ according to claim 15 which includes means for making said fill note generating means effective upon the first occurrence only of a key down signal during a scan of said keyboard means.

18. An electronic organ according to claim 12 in which said fill note generator means includes: a memory having addressing inputs and enabling inputs and outputs, selected ones of the playing keys of said accompaniment portion forming chord playing key means operable when depressed to cause the notes of a respective chord to sound, each chord playing key being connected to supply an addressing signal to the addressing inputs of said memory, signal supply means to supply a signal to the enabling inputs of said memory in conformity with a depressed solo playing key, said memory being operable when addressed and enabled to supply an enabling signal to one of a plurality of second keyers interposed between respective stages of said shift register means and said demultiplexer means.

19. An electronic organ according to claim 18 in which said signal supply means comprises a latch, means for supplying a signal corresponding to the count on the said counter to the input side of said latch and for latching the signal therein in response to the first occurrence of a depressed playing key during a said scan and for clamping the latch between successive scans, and a decoder connecting the output side of said latch to the enabling inputs of said memory.

20. The electronic organ of claim 12 wherein said shift register means is continuously clocked by said counter.

21. In an electronic organ including a keyboard comprising a solo portion and an accompaniment portion, said accompaniment portion including chord playing keys, multiplexer means for scanning at least said solo portion of said keyboard and including a clock driven binary counter, said multiplexer means generating a data stream on each scan of the keyboard containing key down data in the form of a key down signal in a respective time slot for each depressed playing key, and demultiplexer means connected to said multiplexer means, the improvement being fill note generating means operable in response to the development of a key down signal in said data stream and to the depression of a chord playing key for supplying at least one pulse corresponding to a key down signal to the demultiplexer in a time slot different from the time slot pertaining to the respective key down signal, said fill note generating means comprising: a latch having inputs connected to said counter and having a clock terminal which is pulsed on the first occurrence only of a depressed playing key during a scan and having a clear terminal which is pulsed between successive scans, arithmetic logic unit means having one input means connected to the output side of said latch and also having second input means and output means, means for supplying a respective pair of first and second binary inputs to said second input means for each chord playing key which is depressed, and comparator means having first inputs connected to the output means of said logic unit means and second inputs connected to said counter and operable to supply a pulse corresponding to a key down signal to said demultiplexer when the signals at the input means thereof are equal.

22. An electronic organ according to claim 21 in which the keyboard is scanned from the highest note end to the lowest note end and with the count from the counter increasing progressively during each scan, said arithmetic logic unit means being adjusted to add the said second input thereto from the said first input.

23. An electronic organ according to claim 21 in which said means for supplying a second input to said logic unit means comprises a memory having outputs connected to said second inputs of said logic unit means, means for addressing said memory in conformity with the respective chord playing key which is depressed, and means for enabling said memory to supply signals to said logic unit means in conformity with the count of the counter which corresponds to the key down signal which corresponds to said one pulse.

24. An electronic organ according to claim 21 which includes a second logic unit means having first and second inputs and an output, and in which said means for supplying a second input to each said logic unit means comprises a memory having outputs connected to said second inputs of each said logic unit means, and means for addressing said memory in conformity with the respective chord playing key which is depressed, and means for enabling said memory to supply signals to each said logic unit means in conformity with the count of the counter which corresponds to the key down signal which corresponds to said one pulse.

25. An electronic organ according to claim 23 in which said memory develops a pair of words at its said outputs, a data selector interposed between said memory means and said second input of said logic unit means and operable in respective states to supply respective ones of said signals from said memory to said logic unit means, and means for placing said selector in one state at the beginning of a scan and in the other state upon the first occurrence of a depressed playing key during a scan.

26. An electronic organ according to claim 21 in which said means for supplying a second input to said logic unit comprises a first memory having an output connected to an input of said logic unit, a second memory having outputs connected to control terminals of said logic unit and each operable when effective to determine a respective output from said logic unit for each input thereto, and means for making one of the outputs of said second memory effective prior to the first occurrence of a key down during a scan of the solo portion and to make another thereof effective following the said occurrence.

27. In an electronic organ including a keyboard having playing keys and comprising a solo portion normally played by the right hand and an accompaniment portion normally played by the left hand, multiplexer means for scanning at least the solo portion of said keyboard and generating a data stream on each scan of the keyboard containing key down signals in respective time slots for each depressed solo key, and demultiplexer means synchronized with said multiplexer means and responsive to said data stream for actuating said keyers, the improvement being circuitry for producing fill notes comprising: a multiple stage shift register, means for developing a first signal in response to the first occurrence of a depressed in the solo portion of said keyboard during the scan thereof and for supplying said first signal to the first stage of said shift register, means for clocking said shift register in unison with the scanning of said keys to shift the first signal therealong, fill note keyers interposed respectively between selected ones of the shift register stages and said demultiplexer means, and means for enabling at least one of said fill note keyers in conformity with one of the playing keys of said accompaniment portion of said keyboard to cause at least one additional note to sound from the solo portion of said keyboard.

28. The electronic organ of claim 27 wherein said additional note is within the octave immediately below the note corresponding to the depressed key in the solo portion of said keyboard and is harmonically related to the predetermined depressed key in the accompaniment portion of said keyboard.

29. In an electronic organ including a keyboard having playing keys and comprising a solo portion and an accompaniment portion, multiplexer means for scanning at least the solo portion of said keyboard and generating a data stream on each scan of the keyboard containing key down signals in respective time slots for each depressed solo key in the solo portion of said keyboard, said multiplexer means including a clock driven binary counter, demultiplexer means synchronized with said multiplexer means and responsive to key down data in said data stream for actuating said keyers, the improvement being fill note generating means comprising: means for storing the count from said counter which corresponds to the first depressed key in the solo portion of said keyboard and counter during a scan, means for generating a predetermined binary word for each of a predetermined group of keys in the accompaniment portion of said keyboard when depressed, means for combining said predetermined binary word with said stored count to form a further binary word, and means for comparing said further word with the count from said counter and developing an output signal when the compared words are equal and supplying said output signal to said demultiplexer means.

30. The electronic organ of claim 29 wherein said output signal is a pulse.

* * * * *

UNITED STATES PATENT OFFICE

CERTIFICATE OF CORRECTION

Patent No. 4,112,802 Dated September 12, 1978

Inventor(s) John William Robinson, Thomas C. Crosby and Stephen Louis Howell

It is certified that error appears in the above-identified patent and that said Letters Patent are hereby corrected as shown below:

Co. 2, line 58, change "file" to --fill--.

Col. 3, line 15, change "fill note" to --each--.

Col. 3, line 17, insert --chord encoding-- between "the" and "circuit".

Co. 3, line 18, change "data" to --fill note--.

Col. 3, line 47, change "or" to --OR--.

Col. 3, line 48, change "60" to --62--.

Col. 3, line 67, change "Q" to --$\bar{Q}$--.

Col. 5, line 20, change "and" to --to--.

Col. 5, line 21, change "," to --and--.

Col. 5, lines 48 through 50, should be deleted and the following paragraph substituted therefor, which paragraph was deleted in error: --It will be understood that the term "Binary" as used herein merely refers to information or data items (bits) which have one of two discernable states, such as one of high or low voltage, or the like, and does not refer to any particular number system, such as ten based or the like.--

UNITED STATES PATENT OFFICE

CERTIFICATE OF CORRECTION

Patent No. 4,112,802 Dated September 12, 1978

Inventor(s) John William Robinson, Thomas C. Crosby and Stephen Louis Howell

It is certified that error appears in the above-identified patent and that said Letters Patent are hereby corrected as shown below:

Cl. 12, Col. 8, line 68, change "lease" to --least--.

Cl. 2, Col. 7, line 42, change "on" to --of--.

Cl. 22, Col. 10, line 30, change "from" to --to--.

Cl. 27, Col. 11, line 21, insert --key-- after "depressed".

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*